US011760960B2

(12) United States Patent
Schmiedel et al.

(10) Patent No.: US 11,760,960 B2
(45) Date of Patent: Sep. 19, 2023

(54) SOLID FRAGRANCE-CONTAINING COMPOSITION WITH AN INORGANIC/ORGANIC RHEOLOGY MODIFIER MIXTURE

(71) Applicant: Henkel AG & Co. KGaA, Duesseldorf (DE)

(72) Inventors: Peter Schmiedel, Duesseldorf (DE); Danilo Panzica, Hilden (DE); Bernd Larson, Erkelenz (DE); Thomas Holderbaum, Hilden (DE); Luca Bellomi, Duesseldorf (DE); Dieter Nickel, Pulheim (DE); Regina Stehr, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 122 days.

(21) Appl. No.: 16/858,413

(22) Filed: Apr. 24, 2020

(65) Prior Publication Data

US 2020/0255769 A1 Aug. 13, 2020

Related U.S. Application Data

(63) Continuation of application No. PCT/EP2018/078314, filed on Oct. 17, 2018.

(30) Foreign Application Priority Data

Oct. 24, 2017 (DE) ..... 10 2017 218 990.8

(51) Int. Cl.

| | |
|---|---|
| ***C11D 9/44*** | (2006.01) |
| ***C11D 3/04*** | (2006.01) |
| ***C11D 3/12*** | (2006.01) |
| ***C11D 3/20*** | (2006.01) |
| ***C11D 3/22*** | (2006.01) |
| ***C11D 3/40*** | (2006.01) |
| ***C11D 3/50*** | (2006.01) |
| ***C11D 11/00*** | (2006.01) |
| ***C11D 17/00*** | (2006.01) |

(52) U.S. Cl.

CPC ..... *C11D 3/046* (2013.01); *C11D 3/124* (2013.01); *C11D 3/2044* (2013.01); *C11D 3/222* (2013.01); *C11D 3/40* (2013.01); *C11D 3/505* (2013.01); *C11D 11/0017* (2013.01); *C11D 11/0023* (2013.01); *C11D 17/0065* (2013.01)

(58) Field of Classification Search

CPC ..... C11D 3/124; C11D 3/14; C11D 3/505; C11D 9/20; C11D 9/44; C11D 17/0073; C11D 3/2044; C11D 3/2065

See application file for complete search history.

(56) References Cited

U.S. PATENT DOCUMENTS

| | | | | |
|---|---|---|---|---|
| 6,387,861 | B1 * | 5/2002 | Van Asperen | C11D 3/38609 510/298 |
| 6,472,362 | B1 * | 10/2002 | Appel | C11D 1/83 510/294 |
| 6,486,118 | B1 * | 11/2002 | Boskamp | C11D 3/382 510/294 |
| 10,913,920 | B1 * | 2/2021 | van Buskirk | C11D 3/046 |
| 2002/0028757 | A1 * | 3/2002 | Esposito | C11D 3/37 510/446 |
| 2004/0152617 | A1 * | 8/2004 | Murphy | C11D 1/02 510/475 |
| 2016/0222329 | A1 * | 8/2016 | Christensen | C11D 3/2075 |

FOREIGN PATENT DOCUMENTS

| | | | |
|---|---|---|---|
| DE | 19953503 | A1 | 5/2001 |
| DE | 102012218690 | A1 | 4/2014 |

OTHER PUBLICATIONS

PCT International Search Report PCT/EP2018/078314 Completed: Jan. 17, 2019 dated Jan. 24, 2019.

* cited by examiner

*Primary Examiner* — Charles I Boyer
(74) *Attorney, Agent, or Firm* — Thomas Krivulka

(57) ABSTRACT

A solid, particulate composition having at least one water-soluble carrier material, at least one fragrance and at least one water-miscible organic solvent, wherein the carrier material is a water-containing salt (hydrate) whose water vapor partial pressure at a specific temperature in the range from 30 to 100° C. corresponds to the $H_2O$ partial pressure of the saturated solution of this salt, such that the salt melts at this temperature in its own crystal water. The invention further relates to processes for producing the solid composition, and to a washing or cleaning product including the solid composition. In addition, the present invention also relates to the use of a washing or cleaning product of this kind for cleaning of textiles or hard surfaces, and corresponding methods of cleaning textiles or hard surfaces using a washing or cleaning product of this kind.

14 Claims, No Drawings

SOLID FRAGRANCE-CONTAINING COMPOSITION WITH AN INORGANIC/ORGANIC RHEOLOGY MODIFIER MIXTURE

FIELD OF THE INVENTION

The present invention relates to a solid, particulate composition comprising at least one water-soluble carrier material and at least one fragrance, the carrier material being a hydrous salt (hydrate) of which the water vapor partial pressure, at a specific temperature in the range of from 30 to 100° C. corresponds to the $H_2O$ partial pressure of the saturated solution of this salt, such that the salt melts at this temperature in its own water of crystallization. The composition is characterized in that it has significantly improved water solubility compared with known compositions based on polyethylene glycol. Furthermore, the invention relates to methods for preparing the solid composition and to a washing or cleaning agent containing the solid composition. Moreover, the present invention also relates to the use of such a washing or cleaning agent for cleaning textiles or hard surfaces and corresponding methods for cleaning textiles or hard surfaces using such a washing or cleaning agent.

BACKGROUND OF THE INVENTION

When using washing and cleaning agents, the consumer not only aims to wash, clean or care for the objects to be treated, but also wishes that after treatment, for example after washing, the treated objects, such as textiles, have a pleasant smell. For this reason in particular, most commercially available washing and cleaning agents contain fragrances.

Fragrances are often used in the form of fragrance particles, either as an integral component of a washing or cleaning agent, or metered into the washing drum right at the beginning of a wash cycle in a separate form. In this way, the consumer can control the fragrancing of the laundry to be washed by means of individual metering.

The main constituent of such fragrance pastilles known in the prior art is typically a water-soluble or at least water-dispersible carrier polymer, such as polyethylene glycol (PEG), which is used as a vehicle for the integrated fragrances and which dissolves more or less completely in the wash liquor during the waxing process, so as to release the fragrances contained and optionally other components into the wash liquor. For the preparation of the known fragrance pastilles, a melt is produced from the carrier polymer, which melt contains the remaining ingredients or these are then added, and the resulting melt is then fed to a shaping process, in the course of which it cools, solidifies and assumes the desired shape.

The known products have the disadvantage that the polymer materials used, in particular PEG, have delayed solubility, which can lead to residues on the laundry or in the washing machine, in particular in the case of short wash cycles, low temperature or other unfavorable conditions.

BRIEF SUMMARY OF THE INVENTION

The object of the present invention was therefore to identify an alternative composition which exhibits a suitable processing range and at the same time exhibits improved water solubility in the usual temperature ranges in which work is carried out. The corresponding composition should also be characterized by an attractive visual appearance.

The object has been achieved according to the invention by a formulation for melt bodies which comprises a carrier material and one or more fragrances as well as at least one water-soluble organic solvent, the carrier material being a hydrous salt (hydrate) of which the water vapor partial pressure, at a specific temperature in the range of from 30 to 100° C., corresponds to the $H_2O$ partial pressure of the saturated solution of this salt at the same temperature, such that the salt dissolves at this temperature in its own water of crystallization, a process which can be referred to phenomenologically as melting, although this is thermodynamically a solution process.

In a first aspect, the present invention is therefore directed to a solid, particulate composition comprising:

(a) 20 to 95 wt. %, based on the total weight of the composition, of at least one water-soluble carrier material selected from water-containing salts of which the water vapor partial pressure corresponds, at a specific temperature in the range of from 30 to 100° C., to the $H_2O$ partial pressure of the saturated solution of said salt, preferably sodium acetate trihydrate ($Na(CH_3COO)\cdot 3H_2O$);

(b) 0.1 to 20 wt. % of at least one fragrance;

(c) optionally up to 25 wt. %, preferably 0.5 to 3 wt. %, based on the total weight of the composition, of an inorganic rheology modifier, preferably an inorganic rheology modifier from the group of fumed silicas;

(d) optionally up to 25 wt. %, preferably 0.5 to 3 wt. %, based on the total weight of the composition, of an organic rheology modifier, preferably an organic rheology modifier from the group of celluloses, preferably microfibrillated celluloses;

(e) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(f) optionally up to 25 wt. %, based on the total weight of the composition, of at least one solid or filler that is different from (c), (d) and (e);

(g) optionally at least one dye; and (h) 0.1 to 20 wt. % of at least one water-soluble organic solvent.

In a second aspect, the invention is directed to a solid, particulate composition comprising:

(a) 20 to 95 wt. %, based on the total weight of the composition, sodium acetate and/or a hydrate thereof and optionally water, with the proviso that when sodium acetate is used, water is used in an amount which would theoretically be required, based on the amount, to ensure that at least 60 wt. % of the total amount of sodium acetate and its hydrates is in the form of sodium acetate trihydrate;

(b) 0.1 to 20 wt. % of at least one fragrance;

(c) optionally up to 25 wt. %, preferably 0.5 to 3 wt. %, based on the total weight of the composition, of an inorganic rheology modifier, preferably an inorganic rheology modifier from the group of fumed silicas;

(d) optionally up to 25 wt. %, preferably 0.5 to 3 wt. %, based on the total weight of the composition, of an organic rheology modifier, preferably an organic rheology modifier from the group of celluloses, preferably microfibrillated celluloses;

(e) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(f) optionally up to 25 wt. %, based on the total weight of the composition, of at least one solid or filler that is different from (c), (d) and (e);

(g) optionally at least one dye; and (h) 0.1 to 20 wt. % of at least one water-miscible organic solvent.

In a third aspect, the invention is directed to a solid, particulate composition comprising:

(a) 12 to 57 wt. %, based on the total weight of the composition, sodium acetate;

(b) 0.1 to 10 wt. % of at least one fragrance;

(c) optionally up to 25 wt. %, preferably 0.5 to 3 wt. %, based on the total weight of the composition, of an inorganic rheology modifier, preferably an inorganic rheology modifier from the group of fumed silicas;

(d) optionally up to 25 wt. %, preferably 0.5 to 3 wt. %, based on the total weight of the composition, of an organic rheology modifier, preferably an organic rheology modifier from the group of celluloses, preferably microfibrillated celluloses;

(e) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(f) optionally up to 25 wt. %, based on the total weight of the composition, of at least one solid or filler that is different from (c), (d) and (e);

(g) optionally at least one dye;

(h) 0.1 to 20 wt. % of at least one water-miscible organic solvent; and (i) water in an amount that is sufficient to convert at least 60 wt. %, preferably at least 70 wt. %, more preferably at least 80 wt. %, most preferably at least 100 wt. %, of the sodium acetate (a) to sodium acetate trihydrate.

In a fourth aspect, the invention is directed to a solid, particulate composition comprising:

(a) 20 to 95 wt. %, based on the total weight of the composition, sodium acetate trihydrate;

(b) 0.1 to 10 wt. % of at least one fragrance;

(c) optionally up to 25 wt. %, preferably 0.5 to 3 wt. %, based on the total weight of the composition, of an inorganic rheology modifier, preferably an inorganic rheology modifier from the group of fumed silicas;

(d) optionally up to 25 wt. %, preferably 0.5 to 3 wt. %, based on the total weight of the composition, of an organic rheology modifier, preferably an organic rheology modifier from the group of celluloses, preferably microfibrillated celluloses;

(e) optionally up to 25 wt. %, based on the total weight of the composition, of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(f) optionally up to 25 wt. %, based on the total weight of the composition, of at least one solid or filler that is different from (c), (d) and (e);

(g) optionally at least one dye; and (h) 0.1 to 20 wt. % of at least one water-miscible organic solvent.

In yet another aspect, the present invention is directed to the use of the solid composition as described herein as a textile care agent, preferably a fragrancing agent, for fragrancing textile fabrics.

In another aspect, the present invention is further directed to a washing or cleaning agent comprising a solid composition as described herein.

These and other aspects, features, and advantages of the invention will become apparent to a person skilled in the art through the study of the following detailed description and claims. Any feature from one aspect of the invention can be used in any other aspect of the invention. In particular, it is intended that all preferred embodiments described herein can be transferred to all aspects of the invention or be combined therewith. This is especially true for the first to fourth aspects of the invention as described above. Furthermore, it will readily be understood that the examples contained herein are intended to describe and illustrate but not to limit the invention and that, in particular, the invention is not limited to these examples.

DETAILED DESCRIPTION OF THE INVENTION

Unless indicated otherwise, all percentages are indicated in terms of wt. %. Numerical ranges that are indicated in the format "from x to y" also include the stated values. If several preferred numerical ranges are indicated in this format, it is self-evident that all ranges that result from the combination of the various endpoints are also included.

"At least one," as used herein, refers to 1 or more, for example 1, 2, 3, 4, 5, 6, 7, 8, 9 or more. In particular, this expression refers to the type of agent/compound and not to the absolute number of molecules. "At least one fragrance" therefore means that at least one type of fragrance is included but also that 2 or more different types of fragrances may be contained.

"Approximately" or "about," as used herein in relation to numerical values, refers to the numerical value ±10%, preferably ±5%. A temperature of approximately 50° C. thus means 45-55° C., preferably 47.5-52.5° C.

"Water-soluble" as used herein means a solubility in water at 20° C. of at least 1 g/L, preferably at least 10 g/L, more preferably at least 50 g/L.

The solid, particulate composition as described herein is prepared from a solution of the carrier material in the water/water of crystallization contained in the composition, where, for such a solution the term "melt" is also used herein, in contrast to the established use, to denote the state in which the carrier material dissolves by eliminating water in its own water of crystallization and thus forms a liquid. The term "melt" as used herein therefore denotes the liquid state of the composition which results when the temperature at which the carrier material eliminates water of crystallization and then dissolves in the water contained in the composition is exceeded. The invention therefore also relates to the corresponding dispersion containing the herein described (solid) substances dispersed in the melt of the carrier material. Thus, when reference is made below to the solid, particulate composition, the corresponding melt/melt dispersion from which it is obtainable is always included. Since these do not differ in composition except for the state of matter, the terms are used interchangeably herein.

The term "melt body" is used herein to describe the solid particles obtainable from the liquid composition upon cooling by solidification/reshaping.

The main component of the solid particulate composition as described herein is at least one water-soluble carrier material. The at least one carrier material is characterized in that it is selected from hydrous salts of which the water vapor partial pressure, at a specific temperature in the range of from 30 to 100° C., corresponds to the $H_2O$ partial pressure of the saturated solution of this salt at the same temperature. As a result, the corresponding hydrous salt, also referred to herein as a "hydrate," dissolves on reaching or exceeding this temperature in its own water of crystallization, thereby transitioning from a solid to a liquid state of matter. Preferably, the carrier materials according to the invention exhibit this behavior at a temperature in the range of from 40 to 90° C., particularly preferably between 50 and 85° C., even more preferably between 55 and 80° C.

In particular, sodium acetate trihydrate ($Na(CH_3COO)\cdot 3H_2O$), Glauber's salt ($Na_2SO_4\cdot 10H_2O$), trisodium phosphate dodecahydrate ($Na_3PO_4.12H_2O$) and strontium chloride hexahydrate ($SrCl_2\cdot 6H_2O$) are included in the previously described water-soluble carrier materials from the group of hydrous salts.

A particularly suitable hydrate is sodium acetate trihydrate ($Na(CH_3COO)\cdot 3H_2O$), since it dissolves in the particularly preferred temperature range of from 55 to 80° C., specifically at approximately 58° C., in its own water of crystallization. The sodium acetate trihydrate can be used directly as such, but it is alternatively also possible to use anhydrous sodium acetate in combination with free water, the trihydrate then forming in situ. In such embodiments, the water is used in a substoichiometric or hyperstoichiometric amount, based on the amount required to convert all the sodium acetate to sodium acetate trihydrate, preferably in an amount of at least 60 wt. %, preferably at least 70 wt. %, more preferably at least 80%, most preferably 90 wt. %, 100 wt. % or more, of the amount theoretically required to convert all of the sodium acetate to sodium acetate trihydrate ($Na(CH_3COO)\cdot 3H_2O$). The hyperstoichiometric use of water is particularly preferred. With respect to the compositions according to the invention, this means that when (anhydrous) sodium acetate is used alone or in combination with a hydrate thereof, preferably the trihydrate, water is also used, the amount of water being at least equal to the amount that would be stoichiometrically required to ensure that at least 60 wt. % of the total amount of sodium acetate and its hydrates, preferably at least 70 wt. %, more preferably at least 80 wt. %, even more preferably at least 90 wt. %, most preferably at least 100 wt. %, is present in the form of sodium acetate trihydrate. As already described above, it is particularly preferable for the amount of water to exceed the amount that would be theoretically required to convert all of the sodium acetate to the corresponding trihydrate. This means, for example, that a composition containing 50 wt. % anhydrous sodium acetate and no hydrate thereof contains at least 19.8 wt. % water (60% of 33 wt. %, which would be theoretically required to convert all of the sodium acetate to the trihydrate).

All of the embodiments described below can be explicitly combined with both of the aforementioned alternatives.

In various embodiments, the at least one carrier material is used in such an amount that the resulting melt body, i.e. the fragrance pastille, contains from 30 to 95 wt. % of the carrier material, preferably from 40 to 90 wt. %, for example 45 to 90 wt. %, based on the total weight of the melt body.

Another component of the particulate, solid composition as described herein is at least one fragrance. A fragrance is a chemical substance that stimulates the sense of smell. In order to be able to stimulate the sense of smell, it should be possible to at least partially distribute the chemical substance in the air, i.e. the fragrance should be volatile at 25° C. at least to a small extent. If the fragrance is very volatile, the odor intensity abates quickly. At a lower volatility, however, the smell is more lasting, i.e. it does not disappear as quickly. In one embodiment, the fragrance therefore has a melting point in the range of from −100° C. to 100° C., preferably from −80° C. to 80° C., more preferably from −20° C. to 50° C., in particular from −30° C. to 20° C. In another embodiment, the fragrance has a boiling point in the range of from 25° C. to 400° C., preferably from 50° C. to 380° C., more preferably from 75° C. to 350° C., in particular from 100° C. to 330° C.

Overall, in order to act as a fragrance, a chemical substance should not exceed a certain molecular weight since, if the molecular weight is too high, the required volatility can no longer be ensured. In one embodiment, the fragrance has a molecular weight of from 40 to 700 g/mol, more preferably from 60 to 400 g/mol.

The odor of a fragrance is perceived by most people as pleasant and often corresponds to the smell of, for example, flowers, fruits, spices, bark, resin, leaves, grasses, mosses and roots. Fragrances can thus also be used to overlay unpleasant odors or even to provide a non-smelling substance with a desired odor. It is possible, for example, to use individual odorant compounds, such as synthetic products of the ester, ether, aldehyde, ketone, alcohol and hydrocarbon types, as fragrances.

Fragrance compounds of the aldehyde type are, for example, adoxal (2,6,10-trimethyl-9-undecenal), anisaldehyde (4-methoxybenzaldehyde), cymal (3-(4-isopropylphenyl)-2-methylpropanal), ethylvanillin, Florhydral (3-3-isopropylphenyl)butanal), helional (3-(3,4-methylenedioxyphenyl)-2-methylpropanal), heliotropin, hydroxycitronellal, lauraldehyde, Lyral (3- and 4-(4-hydroxy-4-methylpentyl)-3-cyclohexene-1-carboxaldehyde), methylnonylacetaldehyde, Lilial (3-(4-tert-butylphenyl)-2-methylpropanal), phenylacetaldehyde, undecylenealdehyde, vanillin, 2,6,10-trimethyl-9-undecenal, 3-dodecen-1-al, alpha-n-amylcinnamaldehyde, melonal (2,6-dimethyl-5-heptenal), 2,4-dimethyl-3-cyclohexene-1-carboxaldehyde (Triplal), 4-methoxybenzaldehyde, benzaldehyde, 3-(4-tert-butylphenyl)-propanal, 2-methyl-3-(para-methoxyphenyl) propanal, 2-methyl-4-(2,6,6-timethyl-2(1)-cyclohexene-1-yl)butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]-decylidene-8)-butanal, octahydro-4,7-methane-1H-indenecarboxaldehyde, 3-ethoxy-4-hydroxybenzaldehyde, para-ethyl-alpha,alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl- 3-cyclohexene-1-carboxaldehyde, 4-(3)(4-methyl-3-pentenyl)-3-cyclohexene carboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctan-1-al, 2-methyl-undecanal, 2-methyldecanal, 1-nonanal, 1-octanal, 2,6,10-trimethyl-5,9-undecadienal, 2-methyl-3-(4-tert-butyl)propanal, dihydrocinnamaldehyde, 1-methyl 4-(4-methyl-3-pentenyl)-3-cyclohexene-1-carboxaldehyde, 5- or 6-methoxyhexahydro-4,7-methanindane-1- or 2-carboxaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxaldehyde, 7-hydroxy-3J-dimethyl-octanal, trans-4-decenal, 2,6-nonadienal, para-tolylacetaldehyde, 4-methylphenylacetaldehyde, 2-methyl-4-(2,6,6-trimethyl-1-cyclohexene-1-yl)-2-butenal, ortho-methoxycinnamaldehyde, 3,5,6-trimethyl-3-cyclohexene-carboxaldehyde, 3J-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanindane-1-carboxaldehyde, 2-methyloctanal, alpha-methyl-4-(1-methylethyl)benzene-acetaldehyde, 6,6-dimethyl-2-norpinen-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propyl-bicyclo[2.2.1]-hept-5-ene-2-carbaldehyde, 9-decenal, 3-methyl-5-phenyl-1-pentanal, methylnonylacetaldehyde, hexanal and trans-2-hexenal.

Fragrance compounds of the ketone type are, for example, methyl-beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyl dihydrojasmonate, menthone, carvone, camphor, Koavone (3,4,5,6,6-pentamethylhept-3-en-2-one), fenchone, alpha-ionone, beta-ionone, gamma-methyl-ionone, fleuramone (2-heptylcyclopentanone), dihydrojasmone, cis-jasmone, iso E Super (1-(1,2,3,4,5,6J,8-octahydro-2,3,8,8-tetramethyl-2-naphthalenyl)-ethan-1-one (and isomers)), methyl cedrenyl ketone, acetophenone, methyl acetophenone, para-methoxy acetophenone, methyl beta-naphthyl ketone, benzyl acetone, benzophenone, para-hydroxyphenyl butanone, celery ketone (3-methyl-5-propyl-2-cyclohexenone), 6-isopropyl decahydro-2-naphthone, dimethyloctenone, Frescomenthe (2-butan-2-yl-cyclohexan-1-one), 4-(1-ethoxyvinyl)-3,3,5,5-tetramethylcyclohexanone, methyl heptenone, 2-(2-(4-methyl-3-cyclohexen-1-yl)propyl)cyclopentanone, 1-(p-menthen-6(2)yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)-indanone, 4-damascol, Dulcinyl(4-(1,3-benzodioxol-5-yl)butan-2-one), hexalone (1-(2,6,6-trimethyl-2-cyclohexen-1-yl)-1,6-heptadien-3-one), isocyclemoneE(2-acetonaphthone-1,2,3,4,5,6,7,8-octahydro-2,3,8,8-tetramethyl), methyl nonyl ketone, methyl cyclocitrone, methyl lavender ketone, orivone (4-tert-amylcyclohexanone), 4-tert-butylcyclohexanone, delphone (2-pentyl-cyclopentanone), muscone (CAS 541-91-3), neobutenone (1-(5,5-dimethyl-1-cyclohexenyl)pent-4-en-1-one), plicatone (CAS 41724-19-0), veloutone (2,2,5-trimethyl-5-pentylcyclopentan-1-one), 2,4,4,7-tetramethyl-oct-6-en-3-one and tetrameran (6,10-dimethylundecen-2-one).

Fragrance compounds of the alcohol type are, for example, 10-undecen-1-ol, 2,6-dimethylheptane-2-ol, 2-methylbutanol, 2-methylpentanol, 2-phenoxyethanol, 2-phenylpropanol, 2-tert-butycyclohexanol, 3,5,5-trimethylcyclohexanol, 3-hexanol, 3-methyl-5-phenyl-pentanol, 3-octanol, 3-phenyl-propanol, 4-heptenol, 4-isopropylcyclohexanol, 4-tert-butycyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, β-terpineol, butyl salicylate, citronellol, cyclohexyl salicylate, decanol, di-hydromyrcenol, dimethylbenzylcarbinol, dimethylheptanol, dimethyloctanol, ethylsalicylate, ethylvaniline, eugenol, farnesol, geraniol, heptanol, hexylsalicylate, isoborneol, isoeugenol, isopulegol, linalool, menthol, myrtenol, n-hexanol, nerol, nonanol, octanol, p-menthane-7-ol, phenylethyl alcohol, phenol, phenyl salicylate, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

Fragrance compounds of the ester type are, for example, benzyl acetate, phenoxyethyl isobutyrate, p-tert-butylcyclohexyl acetate, linalyl acetate, dimethylbenzylcarbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate, and jasmacyclate.

Ethers include, for example, benzyl ethyl ether and Ambroxan. Hydrocarbons mainly include terpenes such as limonene and pinene.

Preferably, mixtures of different fragrances are used, which together produce an appealing fragrance note. Such a mixture of fragrances may also be referred to as perfume or perfume oil. Perfume oils of this kind may also contain natural fragrance mixtures, such as those obtainable from plant sources.

Fragrances of plant origin include essential oils such as angelica root oil, aniseed oil, arnica blossom oil, basil oil, bay oil, champaca blossom oil, citrus oil, abies alba oil, abies alba cone oil, elemi oil, eucalyptus oil, fennel oil, spruce oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, cananga oil, cardamom oil, cassia oil, pine needle oil, copaiba balsam oil, coriander oil, spearmint oil, caraway oil, cumin oil, labdanum oil, lavender oil, lemon grass oil, lime blossom oil, lime oil, mandarin oil, melissa oil, mint oil, musk seed oil, clary sage oil, myrrh oil, clove oil, neroli oil, niaouli oil, olibanum oil, orange blossom oil, orange peel oil, oregano oil, palmarosa oil, patchouli oil, balsam Peru oil, petitgrain oil, pepper oil, peppermint oil, allspice oil, pine oil, rose oil, rosemary oil, sage oil, sandalwood oil, celery oil, spike lavender oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil, and ambrettolide, Ambroxan, alpha-amylcinnamaldehyde, anethole, anisaldehyde, anise alcohol, anisole, anthranilic acid methyl ester, acetophenone, benzylacetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptyne carboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrole, jasmine, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl beta-naphthyl ketone, methyl n-nonylacetaldehyde, methyl n-nonyl ketone, muscone, beta-naphthol ethyl ether, beta-naphthol methyl ether, nerol, n-nonylaldehyde, nonyl alcohol, n-octylaldehyde, p-oxy-acetophenone, pentadecanolide, beta-phenethyl alcohol, phenylacetic acid, pulegone, safrole, salicylic acid isoamyl ester, salicylic acid methyl ester, salicylic acid hexyl ester, salicylic acid cyclohexyl ester, santalol, Sandelice, skatole, terpineol, thymene, thymol, troenan, gamma-undecalactone, vanillin, veratraldehyde, cinnamaldehyde, cinnamyl alcohol, cinnamic acid, cinnamic acid ethyl ester, cinnamic acid benzyl ester, diphenyl oxide, limonene, linalool, linalyl acetate and propionate, melusate, menthol, menthone, methyl-n-heptenone, pinene, phenylacetaldehyde, terpinyl acetate, citral, citronellal and mixtures thereof.

In one embodiment, it may be preferable for at least some of the fragrance to be used as a fragrance precursor or in encapsulated form (fragrance capsules), in particular in microcapsules. However, it is also possible to use the entire fragrance in encapsulated or non-encapsulated form. The microcapsules may be water-soluble and/or water-insoluble microcapsules. For example, melamine-urea-formaldehyde microcapsules, melamine-formaldehyde microcapsules, urea-formaldehyde microcapsules or starch microcapsules may be used. "Fragrance precursor" refers to compounds that release the actual fragrance only after chemical conversion/cleavage, typically by exposure to light or other environmental conditions such as pH, temperature, etc. Such compounds are often also referred to as fragrance storage substances or "pro-fragrances."

Irrespective of the form in which they are used, the amount of fragrance in the composition is preferably of from 1 to 20 wt. %, preferably 1 to 15 wt. % and in particular from 3 to 12 wt. %, based on the total weight of the composition. It is a feature of the present invention that the fragrance is, or the fragrance particles are, homogeneously distributed in the carrier material and in particular is not present as a coating of a core of carrier material.

In various embodiments, the composition according to the invention does not contain polyethylene glycol (PEG) that is solid at room temperature (25° C.) in the form of a coating, more preferably the composition does not contain any PEG that is solid at room temperature (25° C.), i.e., the content of PEG that is solid at room temperature (25° C.) is less than 1 wt. % based on the composition.

In further embodiments, the composition according to the invention does not contain any polyethylene glycol (PEG) at all in the form of a coating, more preferably the composition does not contain any PEG at all, i.e., the content of PEG that is solid or liquid at room temperature is less than 1 wt. % based on the composition.

The composition may further contain an inorganic substance, preferably fumed silica, for adjusting the viscosity/rheological properties of the melt. This is preferably contained in the composition in an amount of from 0.1 to 20 wt. %, preferably 0.5 to 3 wt. %, more preferably 1 to 2.5 wt. %, even more preferably 1.2 to 2.0 wt. %. The silicic acids used are preferably highly dispersed silicic acids, for example those having BET surface areas of more than 50 $m^2/g$, preferably more than 100 $m^2/g$, more preferably 150 to 250 $m^2/g$, in particular 175 to 225 $m^2/g$.

Suitable silicic acids are commercially available from Evonik under the tradenames Aerosil® and Sipernat®. Aerosil® 200 is particularly preferred.

In various embodiments, the composition may additionally or alternatively contain further (at 20° C. and 1 bar) solid or liquid ingredients which may be used to adjust desired properties of the composition. Such properties may also be the viscosity or the rheological properties of the melt. Such substances are, for example, organic rheology modifiers, preferably cellulose, in particular microfibrillated cellulose (MFC, nanocellulose). Particularly suitable as cellulose are MFCs, as are commercially available as Exilva (Borregaard) or Avicel® (FMC), for example. In addition, or as an alternative to the above-mentioned substances, it is possible for further solids or fillers which differ from the above-mentioned substances to be contained.

Microfibrillated cellulose (MFC) is preferably used in amounts of up to 5 wt. %, particularly preferably 0.1 to 3 wt. %, more preferably 0.3 to 2 wt. %, in each case based on the total weight of the composition.

Emulsifying substances such as fatty alcohols, for example stearyl alcohol, fatty alcohol alkoxylates, such as fatty alcohol ethoxylates used as nonionic surfactants, fatty alcohol sulfates, fatty alcohol ether sulfates and alkylbenzene sulfonates are also suitable as ingredients, in particular those which are also used as anionic surfactants. Suitable fatty alcohol ethoxylates are in particular the C10-22 fatty alcohol ethoxylates with up to 50 EO, very particularly preferably the C12-18 alkyl ethers with 5-8 EO, preferably 7 EO, or the C16-18 alkyl ethers with up to 30 EO. Suitable fatty alcohol ether sulfates are the sulfates of the above-mentioned fatty alcohol ethers, suitable fatty alcohol sulfates, in particular the C10-18 fatty alcohol sulfates, very particularly the C12-16 fatty alcohol sulfates. The linear C10-13 alkylbenzene sulfonates in particular are suitable as alkylbenzene sulfonates. In summary, emulsifiers from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof are preferred.

The composition may contain further solids or fillers (f) other than constituents (a) to (e). The proportion by weight of these solids or fillers with respect to the total weight of the composition is for example up to 25 wt. %, preferably up to 20 wt. %, more preferably up to 18 wt. %, in particular up to 15 wt. %, based on the total weight of composition.

The composition according to one of the preceding examples, characterized in that the components (c), (d), (e) and (f) are jointly contained therein in amounts of from 0 to 25 wt. %, preferably 1 to 20 wt. %, more preferably 2 to 18 wt. %, in particular 3 to 15 wt. %, based on the total weight of the composition.

The composition may be dyed using suitable dyes in order to improve its appearance. Preferred dyes, which can be selected by a person skilled in the art without any difficulty at all, should be highly stable in storage, unaffected by the other ingredients of the washing or cleaning agent, insensitive to light and should not exhibit pronounced substantivity with respect to textile fibers in order to avoid dyeing said fibers. Such dyes are known in the art and are typically used in concentrations of from 0.001 to 0.5 wt. %, preferably 0.01 to 0.3 wt. %.

As stated at the outset, the compositions according to the invention are distinguished by comparison with the known compositions of the prior art by an improved solubility profile and an improved fragrance effect. At the same time, however, these compositions tend to produce unesthetic "salt efflorescence" on their surface, depending on the exact manufacturing and/or storage conditions. These particle surface changes particularly affect the appearance of dye-containing compositions. Another object was therefore to prevent or at least mitigate this efflorescence by means of formulation measures.

Surprisingly, it has been found that the above-described unesthetic surface changes of the compositions can be prevented by the addition of at least one water-miscible organic solvent. For this reason, the compositions according to the invention contain at least one water-miscible organic solvent as another essential constituent.

The water-miscible organic solvents are preferably less volatile and odorless. Suitable water-miscible organic solvents are, for example, monohydric and polyhydric alcohols, alkyl ethers, dimolecular or low-molecular-weight polyalkylene ethers which are liquid at room temperature. The solvents are preferably selected from ethanol, n-propanol, i-propanol, butanols, glycol, propanediol, butanediol, methylpropanediol, diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether (1,2-propanediol) and mixtures of these solvents.

Particular preference is given to dipropylene glycol, 1,2-propylene glycol and glycerol, since they are particularly readily miscible with water and also do not undergo any adverse reactions with the other constituents of the composition.

The proportion by weight of the water-miscible organic solvent with respect to the total weight of the composition is preferably 0.1 to 10 wt. %, preferably 0.5 to 8 wt. %, and in particular 1 to 6 wt. %.

As described above, the composition may potentially also contain free water. The term "free water" as used herein denotes water which is not bound as water of crystallization in any of the salts contained in the composition.

A composition as described herein may be used for example in the wash cycle of a laundry cleaning process and thus may transport the perfume to the laundry right at the beginning of the washing process. Furthermore, the composition according to the invention is easier and better to handle than liquid compositions since, during subsequent storage of the bottle, no drops are left on the edge of the bottle that run down to the edges on the ground or result in unpleasant deposits in the region of the bottle cap. The same applies to the case in which, during metering, some of the composition is accidentally spilled. The spilled amount can also be removed more easily and cleanly. This application further relates to a method for the treatment of textiles, in the course of which a composition according to the invention is metered into the wash liquor of a textile washing machine.

The composition may optionally contain other conventional ingredients, for example those which improve the practical and/or aesthetic properties.

Example formulations of suitable compositions include the following ingredients:

- 1 to 15 wt. %, in particular 2 to 8 wt. %, perfume oil and/or fragrance capsules;
- 0.00 to <1 wt. % dye(s);
- 1.0 to 2.5, especially 1.2 to 2.0 wt. % fumed silica (BET 175-225) or 0.1 to 3.0, in particular 0.1 to 2 wt. %, microfibrillated cellulose;
- 0.1 to 10 wt. % of at least one water-miscible organic solvent; and
- up to 100 wt. % carrier material, as defined herein, in particular sodium acetate trihydrate.

The composition of some preferred compositions can be found in the following tables (amounts given in wt. % based on the total weight of the agent, unless otherwise indicated). Dipropylene glycol, 1,2-propylene glycol or glycerol are preferably used as the water-miscible organic solvent.

| | Formula 1 | Formula 2 | Formula 3 | Formula 4 | Formula 5 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 6 | Formula 7 | Formula 8 | Formula 9 | Formula 10 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 11 | Formula 12 | Formula 13 | Formula 14 | Formula 15 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

-continued

| | Formula 16 | Formula 17 | Formula 18 | Formula 19 | Formula 20 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 21 | Formula 22 | Formula 23 | Formula 24 | Formula 25 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 26 | Formula 27 | Formula 28 | Formula 29 | Formula 30 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 31 | Formula 32 | Formula 33 | Formula 34 | Formula 35 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 36 | Formula 37 | Formula 38 | Formula 39 | Formula 40 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 41 | Formula 42 | Formula 43 | Formula 44 | Formula 45 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| (Microfibrillated) cellulose | 0.1 to 25 | 0.1 to 20 | 0.1 to 18 | 0.1 to 15 | 0.1 to 10 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 46 | Formula 47 | Formula 48 | Formula 49 | Formula 50 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| (Microfibrillated) cellulose | 0.1 to 25 | 0.1 to 20 | 0.1 to 18 | 0.1 to 15 | 0.1 to 10 |
| Water-miscible organic solvent | 0.1 to 20 | 0.1 to 10 | 0.5 to 8.0 | 0.5 to 8.0 | 1.0 to 6.0 |

-continued

| | | | | | |
|---|---|---|---|---|---|
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 51 | Formula 52 | Formula 53 | Formula 54 | Formula 55 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| (Microfibrillated) cellulose | 0.1 to 25 | 0.1 to 20 | 0.1 to 18 | 0.1 to 15 | 0.1 to 10 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 56 | Formula 57 | Formula 58 | Formula 59 | Formula 60 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| (Microfibrillated) cellulose | 0.1 to 25 | 0.1 to 20 | 0.1 to 18 | 0.1 to 15 | 0.1 to 10 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 61 | Formula 62 | Formula 63 | Formula 64 | Formula 65 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 66 | Formula 67 | Formula 68 | Formula 69 | Formula 70 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 71 | Formula 72 | Formula 73 | Formula 74 | Formula 75 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 76 | Formula 77 | Formula 78 | Formula 79 | Formula 80 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |

-continued

| | | | | | |
|---|---|---|---|---|---|
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 81 | Formula 82 | Formula 83 | Formula 84 | Formula 85 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| (Microfibrillated) cellulose | 0.1 to 25 | 0.1 to 20 | 0.1 to 18 | 0.1 to 15 | 0.1 to 10 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 86 | Formula 87 | Formula 88 | Formula 89 | Formula 90 |
|---|---|---|---|---|---|
| Sodium acetate trihydrate | 20 to 95 | 30 to 95 | 30 to 95 | 40 to 90 | 45 to 90 |
| Perfume oil | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| (Microfibrillated) cellulose | 0.1 to 25 | 0.1 to 20 | 0.1 to 18 | 0.1 to 15 | 0.1 to 10 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 91 | Formula 92 | Formula 93 | Formula 94 | Formula 95 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| (Microfibrillated) cellulose | 0.1 to 25 | 0.1 to 20 | 0.1 to 18 | 0.1 to 15 | 0.1 to 10 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

| | Formula 96 | Formula 97 | Formula 98 | Formula 99 | Formula 100 |
|---|---|---|---|---|---|
| Sodium acetate trihydrate | 20 to 95 | 30 to 95 | 30 to 95 | 40 to 90 | 45 to 90 |
| Perfume oil and fragrance capsules | 0.1 to 20 | 0.1 to 20 | 1.0 to 15 | 1.0 to 15 | 3.0 to 12 |
| Fumed silica | 1.0 to 2.5 | 1.0 to 2.5 | 1.0 to 2.5 | 1.2 to 2.0 | 1.2 to 2.0 |
| (Microfibrillated) cellulose | 0.1 to 25 | 0.1 to 20 | 0.1 to 18 | 0.1 to 15 | 0.1 to 10 |
| Fatty alcohol ethoxylate with 5 to 50 EO | 0.1 to 10 | 0.1 to 5.0 | 0.2 to 5.0 | 0.2 to 3.0 | 0.5 to 2.0 |
| Water-miscible organic solvent | 0.1 to 20 | 0.1 to 10 | 0.5 to 8.0 | 0.5 to 8.0 | 1.0 to 6.0 |
| Dye | 0.001 to 0.5 | 0.001 to 0.5 | 0.001 to 0.5 | 0.01 to 0.3 | 0.01 to 0.3 |
| Misc. | up to 100 | up to 100 | up to 100 | up to 100 | up to 100 |

The composition according to the present invention is a solid, particulate composition. The individual particles of the composition can be referred to as melt bodies that are solid at room temperature and temperatures up to 30° C., preferably up to 40° C.

In various embodiments of the invention, the melt bodies according to the invention are coated. Suitable coating agents are, for example, tablet coatings known from pharmaceutical literature. However, the pastilles can also be waxed, i.e. coated with a wax, or, to protect against caking (agglomeration), be powder-coated with a powdered material, for example a release agent. It is preferred for the coating not to consist of PEG or to comprise it in any significant amount (>10 wt. %, based on the coating).

A method for preparing melt bodies of this kind may include the following steps:

(a) producing, preferably continuously producing and conveying, a melt comprising the at least one water-soluble carrier material;
(b) optionally metering in additional optional ingredients;
(c) metering, preferably continuous metering, of the at least one fragrance, the at least one water-miscible organic solvent and optionally a dye into the melt;
(d) mixing the melt and the at least one fragrance; and
(e) cooling and optionally reshaping the mixture to obtain perfume-containing melt bodies.

The melt bodies prepared in this way may have any desired shape. Shaping takes place in particular in step (d) of the described method. Solid, particulate shapes, such as substantially spherical, figurative, scaled, cuboid, cylindrical, conical, spherical-cap-shaped, lenticular, hemispherical, disk-shaped or acicular particles are preferred. For example, the particles may have a gummy-bear-like, figurative design. On account of their packaging properties and their performance profile, hemispherical particles are particularly preferred.

It is furthermore preferred for the composition to consist of at least 20 wt. %, preferably at least 40 wt. %, particularly preferably at least 60 wt. % and more particularly preferably at least 80 wt. %, particles which have a spatial extension of from 0.5 to 10 mm, in particular 0.8 to 7 mm and particularly preferably 1 to 3 mm, in any spatial direction. On account of their appearance, corresponding particles are characterized by increased customer acceptance.

Finally, it has proven to be advantageous for the metering and the fragrance effect if the composition consists of at least 20 wt. %, preferably at least 40 wt. %, particularly preferably at least 60 wt. % and more particularly preferably at least 80 wt. %, particles which have a particle weight of between 2 and 150 mg, preferably between 4 and 60 mg and in particular between 5 and 10 mg.

The particularly preferred melt bodies described above, in particular those having a particle weight of between 2 and 150 mg, a spatial extent of between 0.5 and 10 mm and a hemispherical three-dimensional shape, can advantageously be prepared by means of pastillation.

In the context of such a preferred method variant, the melt of the water-soluble carrier material is pressed into a heated inner body and a drum-shaped outer tube that is provided with numerous holes and rotates concentrically around the fixed inner body and in the process deposits product drops over the entire width of a circulating cooling belt, preferably a steel belt.

The viscosity (Texas Instruments AR-G2 rheometer, plate/plate, 4 cm diameter, 1,100 μm column, shear rate 10/1 sec) of the mixture as it exits the rotating, perforated outer drum is preferably between 1,000 and 10,000 mPas.

The droplets of the mixture that are discharged from the drop former are solidified on the steel belt so as to form solid melt bodies. The period of time between the dropping of the mixture onto the steel belt and the complete solidification of the mixture is preferably between 5 and 60 seconds, particularly preferably between 10 and 50 seconds and in particular between 20 and 40 seconds.

The solidification of the mixture is preferably supported and accelerated by cooling. The cooling of the drops applied to the steel belt can be direct or indirect. As direct cooling, for example, cooling by means of cold air can be used. However, indirect cooling of the drops by cooling the underside of the steel belt by means of cold water is preferred.

A preferred method for the preparation of hemispherical melt bodies, in particular for preparing the melt bodies described in formulas 1 to 100 with respect to their composition, comprises the following steps:

(a) producing, preferably continuously producing and conveying, a melt comprising the at least one water-soluble carrier material and the buffer system;
(b) optionally metering in additional optional ingredients;
(c) metering, preferably continuous metering, of the at least one fragrance, the at least one water-miscible organic solvent and optionally a dye into the melt;
(d) mixing the melt and the at least one fragrance;
(e) applying drops of the resulting mixture to a cooling belt by means of a drop former having a rotating, perforated outer drum; and
(f) solidifying the drops of the mixture on the steel belt to form solid hemispherical melt bodies.

A very particularly preferred method variant, in particular for the preparation of the melt bodies described in formulas 1 to 100 with respect to their composition, comprises the steps:

(a) producing, preferably continuously producing and conveying, a melt comprising the at least one water-soluble carrier material sodium acetate trihydrate ($Na(CH_3COO)\cdot 3H_2O$) and the buffer system;
(b) optionally metering in additional optional ingredients;
(c) metering, preferably continuous metering, of the at least one fragrance, the at least one water-miscible organic solvent and optionally a dye into the melt;
(d) mixing the melt and the at least one fragrance;
(e) applying drops of the resulting mixture to a cooling belt by means of a drop former having a rotating, perforated outer drum; and
(f) solidifying the drops of the mixture on the steel belt to form solid hemispherical melt bodies.

In various embodiments, producing a melt, i.e. the melting, takes place in step (a) of the methods described herein by heating to a temperature that is not more than 20° C. above the temperature of the carrier material, at which temperature the water vapor partial pressure of the hydrate corresponds to the $H_2O$ partial pressure of the saturated solution of this salt. As already described above, the carrier material can already be used as a hydrate or the hydrate is obtained by combining the anhydrous salt and water in a sub stoichiometric, stoichiometric or hyperstoichiometric amount, preferably a stoichiometric or hyperstoichiometric amount, based on the amount required to convert the entire salt to the desired hydrate, generated in situ before step (a) or in step (a).

Melting can be carried out using any conventional methods and devices known to a person skilled in the art. The melt containing the at least one carrier material is produced, for example, continuously, by the at least one carrier material, the water-miscible organic solvent and optionally further optional constituents of the melt body, such as fumed silica, cellulose, fatty alcohols, fatty alcohol alkoxylates, fatty alcohol sulfates, fatty alcohol ether sulfates, alkylbenzene sulfonates or a solid or filler, alone or in combinations, being continuously supplied to a corresponding device in which it is heated and the melt thus produced further conveyed, for example pumped.

However, the melt can also be prepared separately, for example in a batch process. According to the invention, embodiments are also included in which the components of the melt are mixed together at any time prior to carrying out the method according to the invention and the mixture is stored in molten or cooled solid form until the method is carried out. The melt thus produced can be used as a master batch to which, in the following step, depending on the needs, different fragrances and optionally also other ingredients, such as dyes, are then added.

In a next step, the at least one fragrance is then metered continuously into the melt. For this purpose, the at least one fragrance is preferably used in liquid form, for example as a perfume oil, as a solution in a suitable solvent or as a suspension of perfume capsules in a (typically water-containing) solvent. "Liquid" as used in this context means liquid under the conditions of use, preferably liquid at 20° C. In addition to the fragrance, a dye can also be metered in this step. For example, the dye may be indicative of the type of fragrance, i.e., for a particular fragrance/fragrance mixture a specific dye or dye mixture is used to make the resulting pastilles immediately visually distinguishable.

During preparation, the flow can optionally be controlled by means of flow rate measurement of the individual metered flows, i.e. the melt, the fragrance flow and optionally further ingredient flows. This also allows, for example, for the proportions of the individual components to be adjusted. The ingredients, in addition to the carrier material and the fragrances, can be produced directly together with the carrier material as a melt, be metered in together with the fragrances or be metered separately into the melt. In the latter alternative, the metering-in may take place before or after the metering-in of the fragrances.

In some embodiments, the method according to the invention is characterized in that at least one optional constituent of the melt body, such as fumed silica, cellulose, fatty alcohols, fatty alcohol alkoxylates, fatty alcohol sulfates, fatty alcohol ether sulfates, alkylbenzene sulfonates or a solid or filler, alone or in combinations with the melt produced and conveyed in step (a), are metered in and/or already contained in the melt that is produced and conveyed in step (a).

The mixing of the combined metered flows can then be carried out, in each case directly after the metering-in or downstream after feeding in several or all of the ingredients, using suitable mixers such as conventional static or dynamic mixing units.

After mixing, the melt containing the fragrances, optionally solids and possibly other ingredients, as well as the carrier material, is cooled and optionally supplied to the shaping step in which the melt solidifies and obtains its final shape. Suitable methods for shaping are known to a person skilled in the art. Conventional forms have already been described above.

The invention also relates to the melt bodies obtained by means of the methods described herein and to the use thereof as textile care agents, preferably fragrancing agents for fragrancing textile fabrics. The melt bodies may be a textile treatment agent such as a fabric softener or part of an agent of this kind.

Furthermore, the invention relates to a washing or cleaning agent comprising the melt bodies prepared according to the invention.

By introducing the perfume-containing melt bodies prepared according to the invention into a washing or cleaning agent, the consumer is provided with a textile care washing or cleaning agent (a "2-in-1" washing or cleaning agent) and does not need to meter two agents or require a separate rinse cycle. Since the compositions prepared according to the invention are perfumed, the washing or cleaning agent does not need to be perfumed as well. Not only does this result in lower costs, it is also advantageous for consumers with sensitive skin and/or allergies.

The melt body compositions described herein are particularly suitable for fragrancing textile fabrics and are, for this purpose, together with a conventional washing or cleaning agent, brought into contact with the textile fabrics in the (main) wash cycle of a conventional washing and cleaning process.

If the melt body composition according to the invention is part of a washing or cleaning agent, a solid washing or cleaning agent may preferably be mixed with 1 to 20 wt. %, in particular 5 to 15 wt. %, of the composition according to the invention.

The preferred embodiments described in connection with the methods according to the invention can likewise be transferred to the melt bodies as such, to the washing and cleaning agents containing said bodies and to the uses described herein, and vice versa.

In summary, the present invention provides, inter alia:

1. A solid, particulate composition comprising:
   (a) 20 to 95 wt. %, based on the total weight of the composition, of at least one water-soluble carrier material selected from hydrous salts of which the water vapor partial pressure corresponds, at a specific temperature in the range of from 30 to 100° C., to the $H_2O$ partial pressure of the saturated solution of said salt at the same temperature;
   (b) 0.1 to 20 wt. % of at least one fragrance;
   (c) optionally up to 25 wt. %, preferably 0.5 to 3 wt. %, based on the total weight of the composition, of an inorganic rheology modifier, preferably an inorganic rheology modifier from the group of fumed silicas;
   (d) optionally up to 25 wt. %, preferably 0.5 to 3 wt. %, based on the total weight of the composition, of an organic rheology modifier, preferably an organic rheology modifier from the group of celluloses, preferably microfibrillated celluloses;
   (e) optionally up to 25 wt. %, based on the total weight of the composition, fatty alcohols, fatty alcohol alkoxylates, fatty alcohol sulfates, fatty alcohol ether sulfates, alkylbenzene sulfonates or combinations thereof;
   (f) optionally up to 25 wt. %, based on the total weight of the composition, of at least one solid or filler that is different from (c), (d) and (e);
   (g) optionally at least one dye; and
   (h) 0.1 to 20 wt. % of at least one water-miscible organic solvent.
2. The composition according to point 1, characterized in that the water-soluble carrier material is selected from hydrous salts of which the water vapor partial pressure, at a temperature in the range of from 40 to 90° C., preferably from 50 to 85° C., more preferably from 55 to 80° C., corresponds to the $H_2O$ partial pressure of the saturated solution of this salt, is preferably sodium acetate trihydrate ($Na(CH_3COO)\cdot 3H_2O$).
3. The composition according to one of points 1 or 2, characterized in that the water-soluble carrier material is contained therein in an amount of from 30 to 95 wt. %, preferably from 40 to 90 wt. %, in particular from 45 to 90 wt. %, based on the total weight of the composition.
4. A solid, particulate composition comprising:
   (a) 12 to 57 wt. %, based on the total weight of the composition, sodium acetate;
   (b) 0.1 to 10 wt. % of at least one fragrance;
   (c) optionally up to 25 wt. %, preferably 0.5 to 3 wt. %, based on the total weight of the composition, of an inorganic rheology modifier, preferably an inorganic rheology modifier from the group of fumed silicas;

(d) optionally up to 25 wt. %, preferably 0.5 to 3 wt. %, based on the total weight of the composition, of an organic rheology modifier, preferably an organic rheology modifier from the group of celluloses, preferably microfibrillated celluloses;

(e) optionally up to 25 wt. %, based on the total weight of the composition, fatty alcohols, fatty alcohol alkoxylates, fatty alcohol sulfates, fatty alcohol ether sulfates, alkylbenzene sulfonates or combinations thereof;

(f) optionally up to 25 wt. %, based on the total weight of the composition, of at least one solid or filler that is different from (c), (d) and (e);

(g) optionally at least one dye; and (h) 0.1 to 20 wt. % of at least one water-miscible organic solvent;

(i) water in an amount which is sufficient to convert at least 60 wt. %, preferably at least 70 wt. %, more preferably at least 80 wt. %, most preferably at least 100 wt. %, of the sodium acetate (a) to sodium triacetate trihydrate.

5. The composition according to point 4, characterized in that the sodium acetate is contained therein in an amount of from 18 to 57 wt. %, preferably from 24 to 48 wt. %, in particular from 27 to 45 wt. %, based on the total weight of the composition.

6. A solid, particulate composition comprising:

(a) 20 to 95 wt. %, based on the total weight of the composition, sodium acetate trihydrate;

(b) 0.1 to 10 wt. % of at least one fragrance;

(c) optionally up to 25 wt. %, preferably 0.5 to 3 wt. %, based on the total weight of the composition, of an inorganic rheology modifier, preferably an inorganic rheology modifier from the group of fumed silicas;

(d) optionally up to 25 wt. %, preferably 0.5 to 3 wt. %, based on the total weight of the composition, of an organic rheology modifier, preferably an organic rheology modifier from the group of celluloses, preferably microfibrillated celluloses;

(e) optionally up to 25 wt. %, based on the total weight of the composition, fatty alcohols, fatty alcohol alkoxylates, fatty alcohol sulfates, fatty alcohol ether sulfates, alkylbenzene sulfonates or combinations thereof;

(f) optionally up to 25 wt. %, based on the total weight of the composition, of at least one solid or filler that is different from (c), (d) and (e);

(g) optionally at least one dye; and (h) 0.1 to 20 wt. % of at least one water-miscible organic solvent.

7. The composition according to point 6, characterized in that the sodium acetate trihydrate is contained therein in an amount of from 30 to 95 wt. %, preferably from 40 to 90 wt. %, in particular from 45 to 90 wt. %, based on the total weight of the composition.

8. The composition according to one of the preceding points, characterized in that the at least one fragrance is contained in the composition in an amount of from 1 to 20 wt. %, preferably 1 to 15 wt. %, more preferably 3 to 12 wt. %.

9. The composition according to one of the preceding points, characterized in that the at least one fragrance is used in the form of fragrance capsules and/or perfume oils.

10. The composition according to one of the preceding points, characterized in that the inorganic rheology modifier, in particular the fumed silica, based on the total weight of the composition, is contained in the composition in an amount of 1 to 2.5 wt. %, more preferably 1.2 to 2.0 wt. %.

11. The composition according to one of the preceding points, characterized in that the fumed silica has a BET surface area of more than 50 $m^2/g$, preferably more than 100 $m^2/g$, more preferably 150 to 250 $m^2/g$, in particular 175 to 225 $m^2/g$.

12. The composition according to one of the preceding points, characterized in that the organic rheology modifier, in particular the cellulose, preferably the microfibrillated cellulose, based on the total weight of the composition, is contained in the composition in an amount of from 1 to 2.5 wt. %, more preferably 1.2 to 2.0 wt. %.

13. The composition according to one of the preceding points, characterized in that components (d), (e) and (f) are, independently of one another, contained therein in amounts of from 0 to 25 wt. %, preferably up to 20 wt. %, more preferably up to 18 wt. %, in particular up to 15 wt. %, based on the total weight of the composition.

14. The composition according to one of the preceding points, characterized in that the composition further contains at least one dye, preferably in a concentration of from 0.001 to 0.5 wt. %, particularly preferably 0.01 to 0.3 wt. %, based on the total weight of the composition.

15. The composition according to one of the preceding points, characterized in that the composition does not contain a polyethylene glycol which is solid at room temperature (25° C.) in the form of a coating.

16. The composition according to one of the preceding points, characterized in that the composition contains less than 1 wt. %, based on the total weight, of a polyethylene glycol which is solid at room temperature (25° C.).

17. The composition according to one of the preceding points, characterized in that the composition further contains free water.

18. The composition according to one of the preceding points, characterized in that the composition contains a water-miscible organic solvent from the group dipropylene glycol, 1,2-propylene glycol and glycerol, preferably dipropylene glycol.

19. The composition according to one of the preceding points, characterized in that the composition contains the water-miscible organic solvent, based on its total weight, in amounts of from 0.1 to 10 wt. %, preferably 0.5 to 8 wt. % and in particular 1 to 6 wt. %.

20. The composition according to one of the preceding points, characterized in that the composition is in the form of hemispherical particles.

21. The composition according to one of the preceding points, characterized in that at least 20 wt. %, preferably at least 40 wt. %, particularly preferably at least 60 wt. % and more particularly preferably at least 80 wt. %, of the composition consists of particles which have a spatial extension of between 0.5 and 10 mm, in particular 0.8 to 7 mm and particularly preferably 1 to 3 mm, in any spatial direction.

22. The composition according to one of the preceding points, characterized in that at least 20 wt. %, preferably at least 40 wt. %, particularly preferably at least 60 wt. % and more particularly preferably at least 80 wt. %, of the composition consists of particles which have a particle weight of between 2 and 150 mg, preferably between 4 and 60 mg and in particular between 5 and 10 mg.

23. The use of the solid composition according to one of points 1 to 22 as a textile care agent for fragrancing textile fabrics.

24. A washing or cleaning agent comprising a solid composition according to one of points 1 to 22.

25. A method for preparing the composition according to one of points 1 to 22, comprising:
(a) producing a melt comprising the at least one water-soluble carrier material;
(b) optionally metering in additional optional ingredients;
(c) metering the at least one fragrance, the at least one bittern and optionally a dye into the melt;
(d) mixing the melt and the at least one fragrance; and
(e) cooling and optionally reshaping the mixture to obtain perfume-containing melt bodies.

26. A method for preparing the composition according to one of points 1 to 22, comprising:
(a) producing, preferably continuously producing and conveying, a melt comprising the at least one water-soluble carrier material and the buffer system;
(b) optionally metering in additional optional ingredients;
(c) metering, preferably continuously metering the at least one fragrance, the at least one bittern and optionally a dye into the melt;
(d) mixing the melt and the at least one fragrance;
(e) applying drops of the resulting mixture to a cooling belt by means of a drop former having a rotating, perforated outer drum; and
(f) solidifying the drops of the mixture on the steel belt to form solid melt bodies.

27. A method for treating textiles, in the course of which a composition according to one of points 1 to 22 is metered into the wash liquor of a textile washing machine.

EXAMPLES

Fragrance pastilles of the following composition were prepared (in wt. %):

| | C1 | E1 | E2 |
|---|---|---|---|
| Water-free Na acetate | 55.79% | 53.81% | 52.46% |
| Water | 12.37% | 11.93% | 11.62% |
| Microfibrillated cellulose [1)] | 24.73% | 23.85% | 23.26% |
| Dipropylene glycol | 0.00% | 3.59% | 6.00% |
| Free perfume | 1.86% | 1.80% | 1.75% |
| Capsule slurry | 5.15% | 4.93% | 4.81% |
| Dye solution yellow 10% | 0.02% | 0.02% | 0.02% |
| Dye solution pink, 10% | 0.07% | 0.07% | 0.07% |

[1)] Exilva F01-L ex Borregaard: 2% active substance, remainder water

For the preparation, the mixture of the components was heated to a temperature of 70° C. and homogenized with stirring. In the process, the sodium acetate dissolves in the existing water. Pastilles were prepared by dropping the liquid mixture onto a cooling plate (23° C.) that is temperature-controlled to room temperature. The sodium acetate binds the water as water of crystallization and the pastilles solidify.

Both immediately after the preparation and in particular after two weeks of storage in a closed container, it was found that the pastilles according to the invention had a substantially more esthetic appearance than the comparative example. The color was strong and brilliant, and, unlike the comparative example, no efflorescence or white deposits were seen.

What is claimed is:

1. A solid, particulate composition comprising:
(a) 20 to 95 wt. %, based on the total weight of the composition, of at least one water-soluble carrier material selected from hydrous salts of which the water vapor partial pressure corresponds, at a specific temperature in the range from 30 to 100 ° C., to the $H_2O$ partial pressure of the saturated solution of said salt at the same temperature;
(b) 0.1 to 20 wt. % of at least one fragrance;
(c) from 0.5 to 3 wt. %, based on the total weight of the composition, of an inorganic rheology modifier selected from the group of fumed silicas;
(d) from 0.5 to 3 wt. %, based on the total weight of the composition, of an organic rheology modifier selected from the group of microfibrillated celluloses;
(e) optionally up to 25 wt. % of an emulsifier;
(f) from 1 to 20 wt. %, based on the total weight of the composition, of at least one solid or filler that is different from (c), (d) and (e);
(g) at least one dye; and
(h) 0.1 to 20 wt. % of at least one water-miscible organic solvent wherein the composition does not contain any polyethylene glycol and wherein the particulate composition is in the form of hemispherical particles wherein at least 80% of the particles have a particle weight of between 2 and 150 mg.

2. The composition according to claim 1, wherein the water-soluble carrier material:
(A) is selected from hydrous salts of which the water vapor partial pressure, at a temperature in the range from 40 to 90 ° C., corresponds to the $H_2O$ partial pressure of the saturated solution of this salt; and/or
(B) is contained therein in an amount from 30 to 95 wt. % based on the total weight of the composition.

3. The composition according to claim 1, wherein the at least one fragrance:
(A) is contained in the composition in an amount from 1 to 20 wt. %; and/or
(B) is used in the form of fragrance capsules and/or perfume oils.

4. The composition according to claim 1, wherein fumed silica:
(A) is contained in the composition in an amount from 1 to 2.5 wt. %; and/or
(B) has a BET surface area of more than 50 $m^2/g$.

5. The composition according to claim 1, wherein it contains a water-miscible organic solvent from the group dipropylene glycol, 1,2-propylene glycol and glycerol.

6. The composition according to claim 1, wherein it contains the water-miscible organic solvent, based on its total weight, in amounts from 0.1 to 10 wt.

7. The composition according to claim 1, wherein it further contains free water.

8. A method for preparing the composition according to claim 1, comprising:
(a) producing a melt comprising the at least one water-soluble carrier material;
(b) optionally metering in additional optional ingredients;
(c) metering the at least one fragrance, the at least one water-miscible organic solvent and optionally a dye into the melt;

(d) mixing the melt and the at least one fragrance; and (e) cooling and optionally reshaping the mixture to obtain perfume-containing melt bodies.

9. A washing or cleaning agent comprising a solid composition according to claim 1.

10. The composition according to claim 1, wherein it comprises an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof.

11. The composition according to claim 2, wherein the hydrous salt is sodium acetate trihydrate ($Na(CH_3COO) \cdot 3H_2O$).

12. The composition according to claim 5, wherein the water-miscible organic solvent is dipropylene glycol.

13. The composition according to claim 1, wherein it contains at least one dye in a concentration from 0.001 to 0.5 wt. % based on the total weight of the composition.

14. The composition according to claim 13, wherein it contains at least one dye in a concentration from 0.01 to 0.3 wt. % based on the total weight of the composition.

* * * * *